US008074827B2

(12) United States Patent
Pettit et al.

(10) Patent No.: US 8,074,827 B2
(45) Date of Patent: Dec. 13, 2011

(54) BEVERAGE CUP FOR DRINKING USE IN SPACECRAFT OR WEIGHTLESS ENVIRONMENTS

(76) Inventors: Donald Roy Pettit, Houston, TX (US); Mark Milton Weislogel, Tigard, OR (US); Paul Concus, Kensington, CA (US); Robert Finn, Palo Alto, CA (US)

( * ) Notice: Subject to any disclaimer, the term of this patent is extended or adjusted under 35 U.S.C. 154(b) by 189 days.

(21) Appl. No.: 12/612,698

(22) Filed: Nov. 5, 2009

(65) Prior Publication Data

US 2011/0101009 A1 May 5, 2011

(51) Int. Cl.
*A47G 19/22* (2006.01)

(52) U.S. Cl. ..... 220/710.5; 220/719; 220/DIG. 13

(58) Field of Classification Search ..... 220/2, 710.5, 220/DIG. 13; D9/522, 523, 529, 531, 559, D9/561, 575
See application file for complete search history.

(56) References Cited

U.S. PATENT DOCUMENTS

| | | | | | |
|---|---|---|---|---|---|
| 11,898 | A | * | 11/1854 | Martin | 209/376 |
| 32,158 | A | * | 4/1861 | Treadwell | 220/2 |
| 38,188 | A | * | 4/1863 | Treadwell | 220/2 |
| 41,244 | A | * | 1/1864 | Treadwell | 220/2 |
| 59,925 | A | * | 11/1866 | Pocock | 220/2 |
| 60,349 | A | * | 12/1866 | Eltinge | 220/2 |
| 61,054 | A | * | 1/1867 | Cowan | 220/2 |
| 80,203 | A | * | 7/1868 | Morse | 220/2 |
| 133,806 | A | * | 12/1872 | Smith | 220/2 |
| 134,253 | A | * | 12/1872 | Clark | 220/2 |
| 165,515 | A | * | 7/1875 | Steele | 220/2 |
| 214,077 | A | * | 4/1879 | Arnold | 220/2 |
| 222,347 | A | * | 12/1879 | Easterbrook | 220/2 |
| 279,871 | A | * | 6/1883 | Hoff | 220/2 |
| 298,180 | A | * | 5/1884 | Cook | 220/521 |
| 305,119 | A | * | 9/1884 | Van Hagen | 220/2 |
| 314,454 | A | * | 3/1885 | Kingsley | 220/2 |
| 325,595 | A | * | 9/1885 | Duncan | 220/2 |
| 335,776 | A | * | 2/1886 | Rock | 209/353 |
| 459,619 | A | * | 9/1891 | Whitney | 220/2 |
| 654,823 | A | * | 7/1900 | Beritzhoff | 220/521 |
| 677,100 | A | * | 6/1901 | Oppold | 220/2 |
| 782,678 | A | * | 2/1905 | Mathers | 220/2 |
| D41,819 | S | * | 10/1911 | Albright, Jr. | D9/764 |
| 1,033,770 | A | * | 7/1912 | Beecher | 220/2 |
| 1,217,706 | A | * | 2/1917 | Clark | 220/2 |

(Continued)

OTHER PUBLICATIONS

Concus, P., Finn, R., On the Behavior of a Capillary Free Surface in a Wedge, Proc. Nat. Acad. Sci. U.S.A. vol. 63, No. 2, Jun. 1969, pp. 292-299.

(Continued)

*Primary Examiner* — J. Gregory Pickett
*Assistant Examiner* — Ned A Walker

(57) ABSTRACT

A beverage cup comprised by an open top and at least one channel defined by a corner with an acute angle so placed that the channel runs along the cup side from the cup bottom to the cup rim. In the absence of significant gravitational force as found in microgravity, weightless or weightlessness of spacecraft or the International Space Station, capillary forces between the beverage and the cup wall allow the beverage to creep along the channel and be in near proximity to the open cup rim. Lips placed at or near the channel at the rim can readily sip, drink, and consume the beverage without the need for a straw and without undue spillage for normal drinking motions including toasting. The channel conducts the beverage via capillary forces from the bottom of the cup to the rim until the beverage has been consumed.

5 Claims, 2 Drawing Sheets

U.S. PATENT DOCUMENTS

| | | | | | |
|---|---|---|---|---|---|
| 1,225,989 | A | * | 5/1917 | Miller | 220/2 |
| 1,413,518 | A | * | 4/1922 | Colling | 220/503 |
| 1,427,613 | A | * | 8/1922 | Martin | 220/2 |
| 1,500,048 | A | * | 7/1924 | Bimler | 220/2 |
| D165,671 | S | * | 1/1952 | Stengren | D9/523 |
| D216,460 | S | * | 1/1970 | Gibson | D9/523 |
| D293,652 | S | * | 1/1988 | Peters | D23/211.1 |
| D314,139 | S | * | 1/1991 | Ambasz | D9/523 |
| D357,867 | S | * | 5/1995 | Beier-Rosetti | D9/523 |
| D357,868 | S | * | 5/1995 | Beier-Rosetti | D9/523 |
| D389,742 | S | * | 1/1998 | Toleman | D9/523 |
| 5,794,810 | A | * | 8/1998 | Hensley | 209/370 |
| D446,346 | S | * | 8/2001 | Angeletta | D28/7 |
| D535,530 | S | * | 1/2007 | Clement | D7/629 |
| D558,393 | S | * | 12/2007 | Angeletta | D28/7 |
| D574,247 | S | * | 8/2008 | Maddy | D9/529 |
| D597,407 | S | * | 8/2009 | Maddy | D9/523 |

OTHER PUBLICATIONS

Concus, P., Existence Criteria for Fluid Interfaces in the Absence of Gravity, Waves on Fluid Interfaces, Academic Press, c1983, pp. 113-122.

Concus, P., Finn, R., Weislogel, M., Capillary Surfaces in an Exotic Container; Results from Space Experiments, J. Fluid Mech. vol. 394, 1999, pp. 119-135.

Concus, P., Finn, R., Capillary Surfaces in Microgravity, Low Gravity Fluid Dynamics and Transport Phenomena, vol. 130, AIAA, c1990, pp. 183-205.

Weislogel, M., Capillary Flow in Containers of Polygon Section, AIAAJ. 39(12), 2001, pp. 2320-2326.

NASA Video downlink web posting showing the beverage cup in weightlessness on the International Space Station: look for two separate videos: Thanksgiving Toast from Space and One Cup of Coffee to Go http://www.nasa.gov/mission_pages/shuttle/multimedia/Video_Gallery_Collection_archive_6.html.

* cited by examiner

BEVERAGE CUP FOR DRINKING USE IN SPACECRAFT OR WEIGHTLESS ENVIRONMENTS

ORIGIN OF THE INVENTION

The invention described herein was made by employee(s) of the United States Government and may be manufactured or used by or for the Government of the United States of America for governmental purposes without the payment of any royalties thereon or therefor.

BACKGROUND OF THE INVENTION

1. Field of the Invention

The present invention relates generally to a beverage cup with open top, particularly human consumption of beverages in a space station or a weightless or a microgravity environment found in spacecraft and, more particularly, to a beverage cup with an open top from which astronauts or spacecraft crewmembers or spacecraft visitors can consume beverages without the use of a straw.

2. Description of the Related Art

Standard art presented in a beverage cup with open top and rim simply will not work in the weightless or microgravity environment found on a space station or on a spacecraft. The beverage, once placed in the cup, will cling to the bottom due to capillary forces regardless of the cup orientation and thus prevent the beverage from being sipped or drunk by placing your lips in contact with the open rim. Secondly, small movements of the cup will cause the beverage to spill or float free from the cup's open top due to capillary forces being weaker than the inertial forces resulting from cup motion. These two facts make current art in beverage cups impractical in a weightless environment.

Until now, the method for spacecraft crewmembers to drink liquids in weightless or microgravity environments is to suck the liquid from a flexible drink bag or pouch through a straw affixed to the pouch or a straw-like passage built into the pouch. One of the inventors of this new beverage cup, when as a crewmember on the International Space Station, fabricated, tested, and brought the invention herein to a practical form while within the United States controlled Node 2 module. This art, as brought to practice, then allowed space station crewmembers to sip, drink, and toast beverages, and to move the cup about the cabin without undue spillage for the first time in the history of human space flight. Video downlink showing this art was made public via NASA television and posted on a public NASA websites on Nov. 24, 2008.

Accordingly, it is desirable to provide a beverage cup with open top and rim where the beverage can be sipped and drunk in a manner consistent with how beverage cups are used on Earth. The invention described herein provides an open topped beverage cup that allows astronauts, crewmembers, and visitors such as tourists, to sip, to drink, to toast, to move the cup about without undue spillage, in a manner consistent with life on Earth and thus provides an advancement over prior art for the habitability of humans living in a space station or in the weightless environment of a spacecraft. This is particularly important now with planned long duration space missions where crewmembers will be away from Earth for many months at a time where seemingly small civilized pleasures take on a new level of significance.

SUMMARY OF THE INVENTION

The present invention provides a beverage cup for use in a weightless or microgravity environment where the cup has at least one channel defined by a corner with an included angle with channel so placed that it runs along the cup side from the cup bottom to the cup rim. In the absence of significant gravitational force, capillary forces between the beverage and the cup wall allow the beverage to creep along the channel and be in near proximity to the open cup rim. Only a small quantity of beverage is contained in the channel with the bulk of the beverage remaining at the cup bottom and held in place by capillary forces. Lips placed at or near the channel at the rim can readily sip and drink the beverage, which creeps with demand along the channel, replenished from the bulk of the beverage at the bottom of the cup. This channel, thus conducts the beverage via capillary forces from the bottom of the cup to the rim until the beverage has been consumed.

In general, in another aspect, the invention allows the beverage to flow along the side of the cup channel in weightlessness due to capillary forces where the flow will stop at the rim upon reaching a free surface defined by capillary force equilibrium. Upon lips being place at or near the vicinity of the channel at the rim, the beverage can be sipped and drunk whereby new beverage will flow along the channel from the cup bottom to replace that which was consumed until the cup has been dunk dry. Practice of this invention on the International Space Station showed that the cup could be drunk to near dryness, leaving behind in the cup perhaps a few residual drops of beverage.

In general, in still another aspect, the invention allows for normal motion of the cup in the practice of drinking without undue spillage of beverage from the open cup top as demonstrated on the International Space Station. The beverage is thus controlled due to capillary forces acting over the highly curved equilibrium free surface shape and thus prevents undue spillage or release of free floating spheres of beverage.

In general, in yet another aspect, the invention uses capillary forces to induce the flow of beverage along the channel defined by an included angle. While mathematical theory will predict that the channel angle can have a value greater than 90 degrees, practice of this art on the International Space Station for customary beverages showed that the channel angle must be acute, preferably less than about 40 degrees due to the cup walls having only a practical state of cleanliness and not being clean to the extent that a wall would be in a laboratory experiment for which the basic equations of capillary action are derived.

In general, in one more aspect, the invention requires a wetting condition or partially wetting condition between the beverage and the material of construction making up the cup wall which is generally defined by a contact angle less than about 90 degrees. Moreover, the wetting or partially wetting condition must be defined by the advancing contact angle being less than about 90 degrees, with preference given to wall materials that have advancing contact angles less than about 60 degrees for a practical cup.

In general, in one more aspect, the invention is enhanced by having flexible channel walls so when pinched by fingers, the channel angle can be temporarily decreased to a small value. It was discovered from use on the International Space Station, that when refilling the cup, particularly with wall residue left behind from ingredients common to beverages, that the channel wall wetting conditions were sufficiently altered to reduce the capillary flow along the channel. By temporarily decreasing the channel angle, capillary forces would re-establish the channel flow and the beverage could thus be consumed. An additional advantage of flexible walls is to temporarily reduce the channel angle to a small value when emptying the cup which causes the last few drops of beverage to be directed from the cup bottom to the cup rim where the residual beverage can then be drunk leaving the cup in a state of near dryness.

BRIEF DESCRIPTION OF THE DRAWINGS

A more complete understanding of the invention may be had by reference to the detailed description when taken in conjunction with the accompanying drawings, wherein.

DETAILED DESCRIPTION OF THE DRAWINGS

The present apparatus and method will now be described more fully hereinafter with reference to the accompanying drawings, in which embodiments of the apparatus and method are shown. This innovation may, however, be embodied in many different forms and should not be construed as limited to the embodiments set forth herein; rather, these embodiments are provided so that this disclosure will be thorough and complete and will fully convey the scope of the method to those skilled in the art Like numbers refer to like elements throughout.

The term "about" as used herein may be applied to modify any quantitative representation that could permissibly vary without resulting in a change in the basic function to which it is related. For example, a quantitative angle as disclosed herein may permissibly be different than the precise value if the basic function to which the angle relates does not change.

Reference is made to mathematical equations defined by theoretical analysis and validated by laboratory experiments. While this body of work accurately describes the physics of channel liquid behavior and was demonstrated under conditions using laboratory wall surfaces with pure component liquids, the inventors found this body of art is best used as a general guide for the conditions of inventing a practical cup. A practical beverage cup for use in weightlessness required significant invention to reduce this to practice due to the wall surfaces being less than laboratory clean due to residue left by normal beverages such as drinking water, coffee, tea, said with creamer and or sugar, milk, and fruit flavored drinks sugared and or artificially sweetened.

Figure 1:
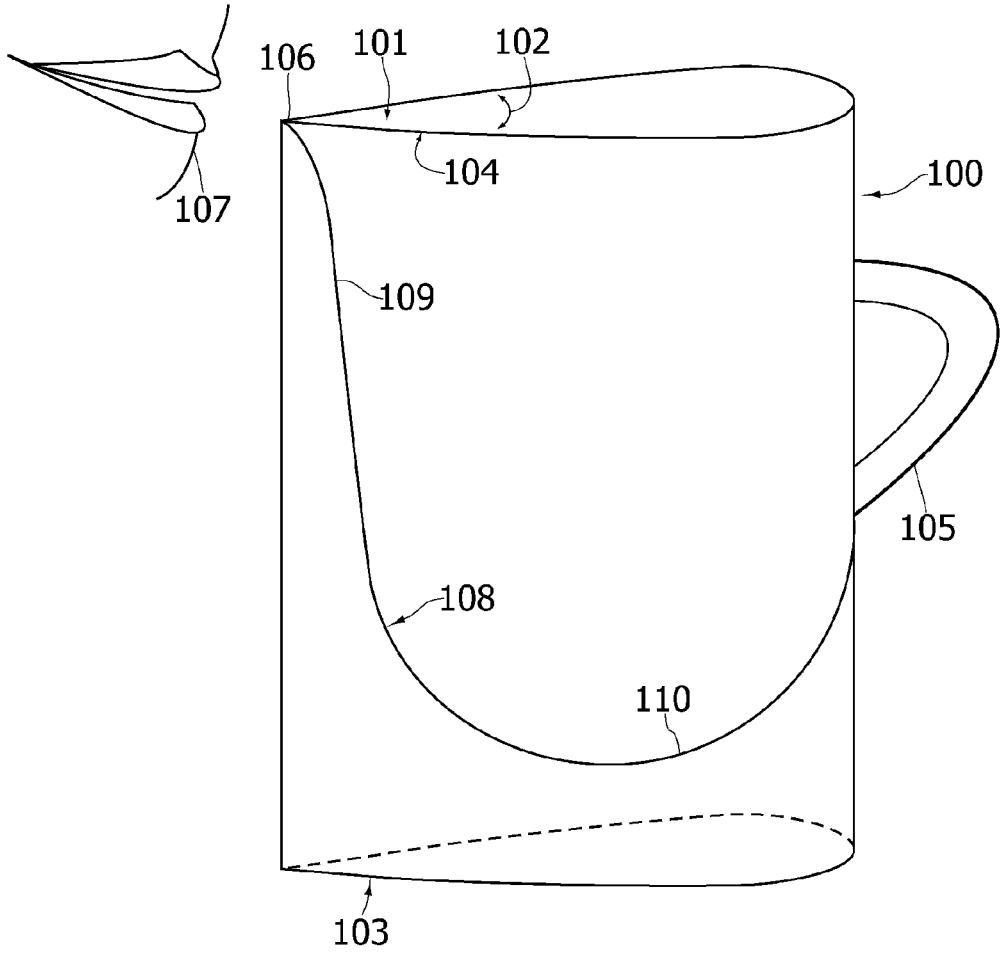
FIG. 1 illustrates a side view of a beverage cup for use in weightlessness with resulting beverage free surface profile according to some embodiments of the invention.

Referring now to FIG. 1, beverage cup 100 according to some embodiments of the invention is shown in side view. The beverage cup 100, has at least one channel 101, defined by included angle 102, running from the cup bottom 103, to the cup open top rim 104, along the cup side and may have an optional handle 105 that may be positioned at any convenient location. It is important for the conduction of beverage to the top of the rim that the intersection 106, between channel 101 and open top rim 104, comes to an abrupt junction but not so sharp as to cause cuts or abrasions to the drinker's lips 107. An approximation to the beverage free surface profile 108 is illustrated as determined from actual photographic data taken on the International Space Station. The free surface profile 108 is established through capillary forces while the cup is being filled and is independent of cup orientation to the surroundings in the spacecraft or space station. The beverage free surface profile 108 consists of a channel profile 109 which holds only a small fraction of the beverage and a curved bottom profile 110 where the bulk of the beverage resides in the cup. To sip or drink from the cup, drinker's lips 107 are placed in near proximity to or in contact with the intersection 106 where the beverage can then be consumed. Capillary forces maintain the channel profile 109 by driving new beverage from the bottom profile 110 as the beverage is consumed from drinker's lips 107 at intersection 106. Capillary forces acting on the beverage will allow the cup to be drunk to near dryness, leaving only a few drops of residual beverage.

Figure 2:
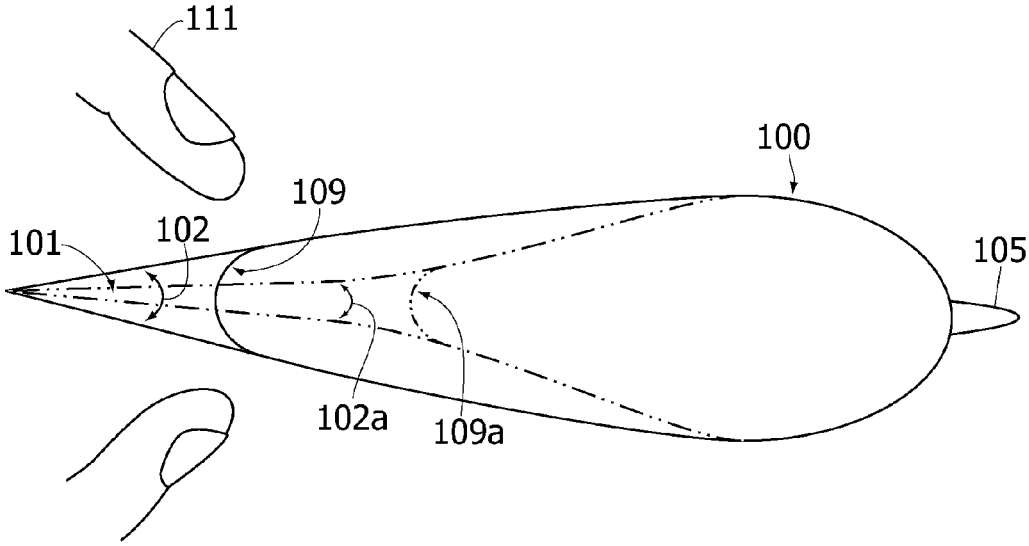
FIG. 2 illustrates a top view of a beverage cup for use in weightlessness according to some embodiments of the invention.

A view from the top of the beverage cup 100 is shown in FIG. 2, with at least one channel 101, defined by included angle 102, and may have an optional handle 105 that may be positioned at any convenient location. An approximation to the beverage free surface channel profile 109 is illustrated as determined from actual photographic data taken on the International Space Station. It is advantageous to make the walls defining channel 101 out of a flexible material so that angle 102 can be temporarily decreased to 102*a* by pinching the walls defining channel 101 with fingers 111 which changes surface profile to 109*a*.

The theoretical conditions required for capillary movement in the absence of significant gravitational force in a two-sided open channel are given by Equation (1) from Concus, P., Finn, R., On the Behavior of a Capillary Free Surface in a Wedge, Proc. Nat. Acad. Sci. U.S.A. Vol. 63, No. 2, June 1969, pp. 292-299:

$$\Phi<2(90°-\theta_{adv}) \qquad \text{Equation (1)}$$

where: $\Phi$ is the included angle between two sides of the channel $\theta_{adv}$ is the advancing contact angle between the liquid and the wall.

If the conditions of Equation (1) are met, capillary forces will move the liquid along the channel until the end is reached where at that point, a local equilibrium profile is established which balances capillary forces and flow stops. Since this is done where gravitational forces are insignificant, there is no mathematical limit on the channel length. There undoubtedly is a practical maximum channel length; however, for the design of a beverage cup, there is no practical concern for channel length. Note that the channel angle $\Phi$ 102 given by Equation (1) is the maximum angle; angles less than this will result in capillary derived motion along the channel and the smaller the angle $\Phi$ 102, the stronger the capillary effect that drives the beverage along the channel. Viscous resistance to flow does increase with decreasing channel angle, however, for practice with typical beverages this was found not to be a concern. It was determined from practice on the International Space Station that the angle $\Phi$ 102 needs to be significantly less than the theoretical condition defined by Equation 1, with best results being less than 40 degrees due to having less than laboratory clean wall surfaces and a variety of possible liquid solutions typical of beverages that differ from a pure laboratory fluid.

The advancing contact angle $\theta_{adv}$ is the angle measured through the liquid between the moving liquid free surface and the wall at the fluid-wall contact. When the advancing contact angle is zero, the fluid-wall system is perfectly wetting, a condition that is observed under some laboratory conditions. For advancing contact angles greater than zero but less than 90 degrees, it is said to be partially wetting. For advancing contact angle $\theta_{adv}$ greater than 90 degrees, the wall-fluid system is non-wetting and corner flow based on Equation (1) will not conduct the fluid along the channel.

Some advancing contact angles $\theta_{adv}$ for drinking water on a number of common wall materials under practical conditions (not laboratory cleaned walls and not chemically pure water) are: glass about 5-10 degrees, glazed ceramic about 10-50 degrees, polycarbonate plastics about 60-70 degrees, polyethylene about 80 to 95 degrees, polymethyl methacrylate (trade name Plexiglas) about 70-80 degrees, aluminum about 50-70 degrees, stainless steel about 50-70 degrees, and laser-jet printer transparency film about 10-30 degrees. These values were measured by the inventors for wall materials and are consistent with what is reported in the literature (see Adamson, A. W., *Physical Chemistry of Surfaces,* 3$^{rd}$ ed., Wiley, 1976, p. 352).

For practical use in a beverage cup with a variety of possible beverages and some possible variability in the cleanliness of the wall, values from laboratory conditions of advancing contact angle and the calculated included channel angle are best used as a general guide for its selection of wall material and resulting design.

As a design parameter, the smaller the included channel angle Φ 102, the stronger the capillary driving force along the channel. However, as channel angle decreases viscous forces increase and an optimal balance may be achieved (Weislogel, M. M., Capillary Flow in Containers of Polygonal Section, AIAA J., 39(12), 2001, pp. 2320-2326). In general, using a beverage cup in a weightless environment will work best with a channel containing a small included angle made out of material with a small advancing contact angle. Glass or glazed ceramic, common materials for beverage cups on Earth, would be highly desirable due to their low advancing contact angle, however, the associated hazards from breakage in a weightless or spacecraft environment will exclude their use except as coatings on more robust substrates. Plastics and metal lend themselves as good materials for use in a cup more from flight safety concerns than those of optimum capillary design. Both plastics and metal lend themselves to coatings on the inner wall surface, particularly in the region of the channel, that decrease the advancing contact angle and thus enhance the channel flow. Surface roughness is known to alter the apparent wetting and could be used as a means to enhance capillary derived channel flow. Another factor in the choice of material is transparency. To see the shape of the free surface profile and the cup's ability to move the liquid from the cup bottom to the cup rim is fascinating to watch and thus having a transparent cup may be highly desirable from human habitability concerns. In addition, having a flexible wall where the angle Φ 102 can be made small by temporarily pinching the cup walls with fingers 111 may be desirable particularly when filling a cup with less than clean walls from prior use residue or when drinking the beverage down to the last few drops.

What is claimed is:

1. A beverage cup for containing, dispensing, and drinking a beverage in a weightless environment, the beverage cup comprising:

a closed bottom;

an open top adjacent a rim, the rim delimiting a size and a shape of the open top corresponding to a size and a shape of the closed bottom;

a first sidewall;

a second sidewall coupled to the first sidewall continuously along a common vertical axis and forming an acute angle with a sharp vertex between the first sidewall and the second sidewall, the common vertical axis extending continuously between the closed bottom and the open top;

a curvilinear rear wall disposed opposite from the common vertical axis and integrally joining the first sidewall and the second sidewall; and, a cavity defined by a continuous interior surface bounded by the curvilinear rear wall and the open top, the continuous interior surface extending downward from the sharp vertex in a curvilinear direction, the cavity capable of containing and dispensing a beverage disposed in the cavity when the beverage cup is located in a weightless environment, and the continuous interior surface is substantially wetting along the common vertical axis when the beverage is being dispensed by a user in the weightless environment.

2. The beverage cup according to claim 1, wherein the cavity is bounded by the first sidewall and the second sidewall, the first sidewall and the second sidewall are flexible, thereby enabling adjustment of the acute angle along the sidewall and at the rim.

3. The beverage cup according to claim 1, further comprising a coating disposed on the continuous interior surface.

4. The beverage cup according to claim 1, wherein the continuous interior surface is a rough surface which alters the effective wetting along the common vertical axis.

5. The beverage cup according to claim 1, further comprising a handle coupled to the curvilinear rear wall.

* * * * *